US009671731B2

(12) United States Patent
Matsunaka et al.

(10) Patent No.: US 9,671,731 B2
(45) Date of Patent: Jun. 6, 2017

(54) FIXING MEMBER, FIXING DEVICE, AND IMAGE FORMING APPARATUS

(71) Applicant: CANON KABUSHIKI KAISHA, Tokyo (JP)

(72) Inventors: Katsuhisa Matsunaka, Inagi (JP); Yoshihito Oshima, Yokohama (JP); Toshinori Nakayama, Kashiwa (JP); Yasuhiro Miyahara, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/113,900

(22) PCT Filed: Sep. 25, 2015

(86) PCT No.: PCT/JP2015/004887
§ 371 (c)(1),
(2) Date: Jul. 25, 2016

(87) PCT Pub. No.: WO2016/079917
PCT Pub. Date: May 26, 2016

(65) Prior Publication Data

US 2017/0038707 A1 Feb. 9, 2017

(30) Foreign Application Priority Data

Nov. 17, 2014 (JP) ..... 2014-233134

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/206; G03G 15/2057
See application file for complete search history.

(56) References Cited

U.S. PATENT DOCUMENTS 4,829,931 A * 5/1989 Mogi ..... G03G 15/2057 118/101
7,725,068 B2 5/2010 Matsunaka et al.
(Continued)

FOREIGN PATENT DOCUMENTS

JP 2001-324888 A 11/2001
JP 2004-037666 A 2/2004
(Continued)

OTHER PUBLICATIONS

Toshiharu Enomae, "Study of Paper Science from Basics (I): Manufacturing Technology and Components of Paper," 52(3) Journal of the Imaging Society of Japan 229-234 (2013).

*Primary Examiner* — G. M. Hyder
(74) *Attorney, Agent, or Firm* — Fitzpatrick, Cella, Harper & Scinto

(57) ABSTRACT

A fixing member is provided, including a release layer containing a tetrafluoroethylene-perfluoroalkyl vinyl ether copolymer (PFA), wherein a content of the perfluoroalkyl vinyl ether (PAVE) based on all PFAs in the release layer is 3.0 mol % or more and 5.8 mol % or less, and an elastic layer having an indentation elastic modulus $E_{ITs}$ at a surface thereof and an indentation elastic modulus $E_{ITc}$ at a position in a depth of 50 μm from the surface, $E_{ITs}$ and $E_{ITc}$ being measured at a temperature of 150° C., and $E_{ITs}$ is larger than $E_{ITc}$ and $E_{ITc}$ being 17 MPa or more and 24 MPa or less.

9 Claims, 8 Drawing Sheets

(56) References Cited

U.S. PATENT DOCUMENTS

| | | | |
|---|---|---|---|
| 7,991,341 | B2 | 8/2011 | Matsunaka et al. |
| 9,315,703 | B2 | 4/2016 | Matsunaka et al. |
| 9,395,666 | B2 | 7/2016 | Abe et al. |
| 2010/0189479 | A1 | 7/2010 | Matsunaka et al. |
| 2010/0330374 | A1 | 12/2010 | Kimura et al. |
| 2014/0105659 | A1 | 4/2014 | Miyahara |
| 2014/0107250 | A1 | 4/2014 | Maeda et al. |

FOREIGN PATENT DOCUMENTS

| | | | |
|---|---|---|---|
| JP | 2004-161921 | A | 6/2004 |
| JP | 2008-176300 | A | 7/2008 |
| JP | 2008-224835 | A | 9/2008 |
| JP | 2014-063030 | A | 4/2014 |

* cited by examiner

FIXING MEMBER, FIXING DEVICE, AND IMAGE FORMING APPARATUS

TECHNICAL FIELD

The present invention relates to a fixing member and a fixing device for use in an image forming apparatus using electrophotography, and an image forming apparatus using the same.

BACKGROUND ART

In general, in a fixing device for use in an electrophotographic image forming apparatus such as a copier and a laser printer (hereinafter, also simply referred to as "image forming apparatus"), a pair of heated rotating bodies such as a roller and a roller, a film and a roller, a belt and a roller, a belt and a belt are pressure contacted. Into the pressure contact part formed between the rotating bodies (hereinafter referred to as "fixing nip part"), a recording medium such as paper which holds an image formed of an unfixed toner (hereinafter referred to as "unfixed toner image") is introduced, so that the unfixed toner is heated and melted. Consequently the image is fixed on the recording medium. The rotating body with which the unfixed toner image on the recording medium comes into contact is referred to as a fixing member. The fixing member is referred to as a fixing roller, a fixing film, or a fixing belt, according to the form.

Examples of the known fixing member include a laminate having an elastic layer which contains a silicone rubber or a fluorine rubber and a releasing layer which contains a fluorine resin such as tetrafluoroethylene-perfluoroalkyl vinyl ether (PFA) arranged on a substrate formed of a metal or a heat-resistant resin in this order (Patent Literature 1).

The elastic layer in the fixing member having such a structure has a function for allowing the fixing member to follow the irregularities on a paper surface.

Namely, in formation of an electrophotographic image on a sheet of paper having relatively large irregularities on the surface (so-called rough paper), unevenness in glossiness may occur in the electrophotographic image when the surface of the fixing member cannot sufficiently follow the irregularities. The reason is that the unfixed toner placed on a protrusion on the paper surface is well squashed by the fixing member, while the unfixed toner placed on a concave on the paper surface is fixed without being sufficiently squashed. As a result, the image formed on the concave on the paper surface has a lower glossiness in comparison with the image formed on the protrusion on the paper surface, so that an electrophotographic image having unevenness in glossiness is produced. The elastic layer of the fixing member has a function for imparting flexibility to the surface of the fixing member coming into contact with irregularities, such that the surface is deformed to follow the irregularities.

CITATION LIST

Patent Literature

[PTL 1] Japanese Patent Application Laid-Open No. 2008-224835

[PTL 2] Japanese Patent Application Laid-Open No. 2008-176300

[PTL 3] Japanese Patent Application Laid-Open No. 2004-161921

Non Patent Literature

[NPL 1] Journal of the Imaging Society of Japan, Vol. 52, [3], 2013, pp 229 to 234, "Study of Paper Science from Basics (I)"

SUMMARY OF INVENTION

Technical Problem

Herein, according to the knowledge of the present inventors, among the PFA described in Patent Literature 1, PFA having a content of perfluoroalkyl vinyl ether of 3.0 mol % or more and 5.8 mol % or less exhibits a flexible rubber state at the thermal fixation temperature, for example, at about 150° C., due to having low crystallinity.

Accordingly, the present inventors investigated a fixing member using PFA with a content of perfluoroalkyl vinyl ether of 3.0 mol % or more and 5.8 mol % or less as the release layer which contains a fluorine resin, in order to allow the surface of the fixing member to satisfactorily follow the irregularities of a paper surface with higher accuracy. In the course of investigation, the present inventors found a new problem which still cannot be solved by the fixing member using the flexible PFA as a release layer on a flexible elastic layer.

Namely, the particle size of a toner has been recently micronized due to requirements for resource saving through reduction in toner consumption and for higher image quality. Consequently the amount of toner per unit area of a paper surface on which an electrophotographic image is formed tends to be reduced. As a result, even when an electrophotographic image is formed on a plain paper having a smoother surface than a rough paper, the degradation in quality of the electrophotographic image occurs in some cases.

A typical paper has a three-dimensional network structure of pulp fiber lying on top of each other. Even a plain paper having a smoother surface in comparison with a rough paper has irregularities resulting from the network structure on the surface microscopically. More specifically, the broad leaf tree kraft pulp fiber typically used in a plain paper for electrophotographic imaging has a diameter of about 20 μm (Non Patent Literature 1), so that there exist irregularities of several tens of μm on a paper surface.

FIG. 1A and FIG. 1B are schematic views illustrating the state of particles of toner placed on such a plain paper surface, before thermal fixation (FIG. 1A) and after thermal fixation (FIG. 1B).

In FIG. 1A, a fiber 1*a* and a fiber 1*b* are pulp fibers to constitute a plain paper, with a cross section of the fiber 1*a* in the longitudinal direction and a cross section of the fiber 1*b* in a direction orthogonal to the longitudinal direction being illustrated. Such a plain paper surface has irregularities due to overlapping of the fiber 1*a* and the fiber 1*b*. In FIG. 1A, a particle of toner 2 is placed on the fiber 1*b*, and particles of toner 3*a* and 3*b* are placed on the fiber 1*a*.

When a fixing member in contact with such a plain paper surface on which particles of toner 2, 3*a* and 3*b* are placed is heated under pressure as illustrated in FIG. 1B, the particle of toner 2 on the fiber 1*b* comes into sufficient contact with the fixing member so as to be melted and fixed on the fiber 1*b* through sufficient heating under pressure. The particle of toner 3*a* placed on the fiber 1*a* at a position away from an intersection with the fiber 1*b* also comes into sufficient contact with the fixing member so as to be melted and fixed on the fiber 1*a* through sufficient heating under pressure. In contrast, the particle of toner 3*b* placed on the fiber 1*a* at a position in the vicinity of an intersection with the fiber 1*b* remains as it is on the fiber 1*a* without contact with the fixing member, even with use of the fixing member having a flexible surface. As a result, a portion 4 uncovered with toner is generated on the surface of the fiber 1*a*. Conventionally, in the case of having a large amount of particles of toner placed on a unit area of a sheet of paper, melted particles of toner flow in from the circumference even when unmelted particles of toner exist in the vicinity of the intersection of the fibers 1*a* and 1*b*, so that the portion 4 uncovered with toner is hardly generated. As described above, however, with a reduced amount of particles of toner per unit area on a sheet of paper, the portion 4 uncovered with the toner is more easily generated.

The generation of the portion 4 uncovered with the toner at the intersection of fibers tends to be perceived as image unevenness, for example, in a half-tone image. Accordingly, the present inventors recognized that the technical problem needs to be solved by all means from the viewpoint of further improving the image quality.

The present invention is directed to providing a fixing member capable of stably producing high-quality electrophotographic images for various kinds of paper, having excellent followability for a sheet of paper having relatively large irregularities on the surface such as rough paper, and also for a plain paper having irregularities at the level of the fiber diameter of pulp which composes the paper on the surface.

The present invention is also directed to providing a fixing device and an image forming apparatus which can stably form high-quality electrophotographic images on various kinds of paper.

Solution to Problem

According to one aspect of the present invention, there is provided a fixing member including a substrate, an elastic layer, and a release layer, in this order, the release layer containing a tetrafluoroethylene-perfluoroalkyl vinyl ether copolymer (PFA), wherein a content of the perfluoroalkyl vinyl ether (PAVE) based on all PFA in the release layer is 3.0 mol % or more and 5.8 mol % or less, and wherein the elastic layer has an indentation elastic modulus $E_{ITs}$ at a surface thereof and an indentation elastic modulus $E_{ITc}$ at a position in a depth of 50 μm from the surface, $E_{ITs}$ and $E_{ITc}$ being measured at a temperature of 150° C., and $E_{ITs}$ is larger than $E_{ITc}$ and $E_{ITc}$ is 17 MPa or more and 24 MPa or less.

According to another aspect of the present invention, there is provided a fixing device for fixing an unfixed toner on a recording medium onto the recording medium by heating under pressure, having the fixing member. According to further aspect of the present invention, there is provided an image forming apparatus which forms a toner image on a recording medium, having the fixing device.

Advantageous Effects of Invention

In an aspect of the present invention, it is possible to provide a fixing member capable of stably producing high-quality electrophotographic images for various kinds of paper, having excellent followability to a sheet of paper having relatively large irregularities on the surface such as rough paper, and also to a plain paper having irregularities at the level of the fiber diameter of pulp which composes the paper on the surface.

In another aspect of the present invention, it is possible to provide a fixing device and an image forming apparatus which can stably form high-quality electrophotographic images on various kinds of paper.

Further features of the present invention will become apparent from the following description of exemplary embodiments with reference to the attached drawings.

DESCRIPTION OF EMBODIMENTS

Preferred embodiments of the present invention will now be described in detail in accordance with the accompanying drawings.

In order to find the reason that a fixing member having a flexible release layer disposed on an elastic layer cannot sufficiently follow the irregularities at the level of the fiber diameter of plain paper, the present inventors made detailed observation of the state of the fixing member in contact with the plain paper surface. As a result, the following experimental facts were confirmed.

Figure 2A:
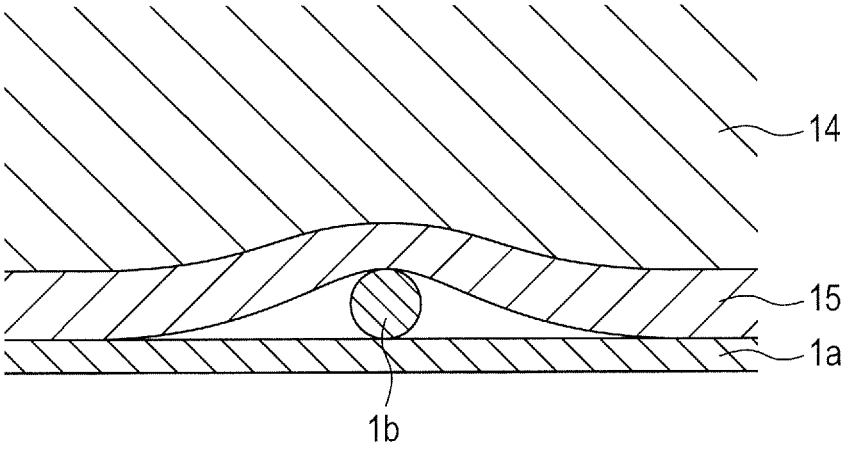
FIG. 2A is a schematic view illustrating the followability of an elastic layer to a plain paper surface, with relatively low $E_{ITs}$.

FIG. 2A is a schematic view illustrating the state of a fixing member having a release layer 15 which includes a flexible fluorine resin disposed on a silicone rubber elastic layer 14 in contact with a plain paper surface in a thermal fixation process. In FIG. 2A, a fiber 1*a* and a fiber 1*b* represent fibers constituting the plain paper.

Figure 1A:
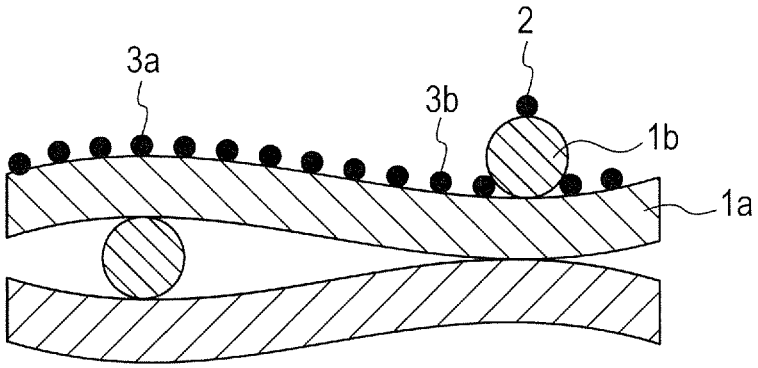
FIG. 1A is a schematic view illustrating the state of particles of toner placed on a plain paper surface before thermal fixation.
Figure 1B:
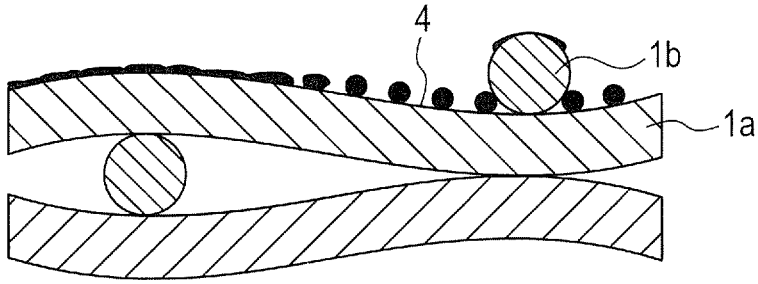
FIG. 1B is a schematic view illustrating the state of toner particles of toner placed on a plain paper surface after thermal fixation.

As described in FIG. 1A, in order to contact the toner 3*b* placed on the fiber 1*a* in the vicinity of the intersection of the fibers 1*a* and 1*b* with a fixing member, the surface of the fixing member needs to be sufficiently deformed relative to the small irregularities at the level of the fiber diameter of plain paper.

On this occasion, when the elastic layer 14 below the release layer 15 has flexibility followable along the relatively large irregularities on the rough paper surface or the like, not only the release layer 15, but also the elastic layer 14 immediately below the fiber 1*b* are deformed by the pressure applied to the release layer 15 through contact with the fiber 1*b*. As a result, the deformation for sufficiently wrapping the circumference of the fiber 1*b* hardly occurs in the release layer 15. It is therefore conceivable that the fixation of the toner 3*b* in FIG. 1A cannot be sufficiently performed, so that an electrophotographic image with noticeable unevenness is formed.

The present inventors therefore made further investigation to obtain a structure of the fixing member capable of sufficiently deforming the release layer 15 in contact with the fiber 1*b* by the pressure applied to the surface of the fixing member. As a result, it was found that the release layer 15 can be more satisfactorily deformed by the pressure applied to the surface in contact with the fiber 1*b*, with the elastic layer 14 having an elastic modulus at the surface on the side in contact the release layer 15 larger than the elastic modulus at a position in a depth of 50 μm from the surface of the elastic layer 14.

Figure 2B:
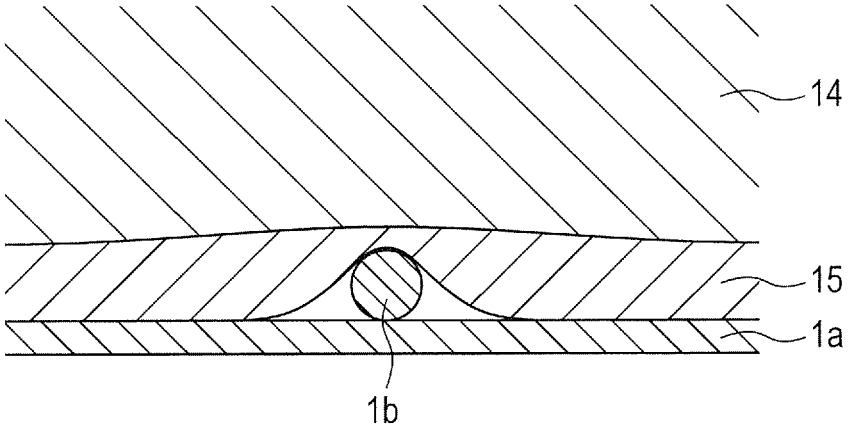
FIG. 2B is a schematic view illustrating the followability of an elastic layer to a plain paper surface, with relatively high $E_{ITs}$.

With reference to FIG. 2B, the fixing member according to an aspect of the present invention is described in detail as follows.

FIG. 2B is a schematic view illustrating the state of the fixing member according to an aspect of the present invention in contact with a plain paper surface in a thermal fixation process. In FIG. 2B, the fixing member according to an aspect of the present invention has a release layer 15 which contains a fluorine resin disposed on an elastic layer 14 which contains a silicone rubber. A fiber 1*a* and a fiber 1*b* represent fibers to compose a plain paper.

The fluorine resin contained in the release layer includes a tetrafluoroethylene-perfluoroalkyl vinyl ether copolymer (PFA), with a content of the perfluoroalkyl vinyl ether based on all PFA in the release layer of 3.0 mol % or more and 5.8 mol % or less.

The elastic layer has an indentation elastic modulus $E_{ITs}$ at a surface thereof and an indentation elastic modulus $E_{ITc}$ at a position in a depth of 50 μm from the surface, $E_{ITs}$ and $E_{ITc}$ being measured at a temperature of 150° C., and $E_{ITs}$ is larger than $E_{ITc}$ and $E_{ITc}$ is 17 MPa or more and 24 MPa or less.

The fixing member having the structure described above has excellent followability to a sheet of paper having relatively large irregularities on the surface such as a rough paper, due to the presence of an elastic layer with an $E_{ITc}$ of 17 MPa or more and 24 MPa or less.

On the other hand, with an elastic layer 14 having $E_{ITs}$ at a surface on the side in contact with the release layer 15 larger than $E_{ITc}$, the release layer 15 can be more satisfactorily deformed by a pressure applied to the surface in contact with the fiber 1*b*.

Namely, as illustrated in FIG. 2B, the fixing member of the present invention can have a deformation volume of the elastic layer 14 in contact with the fiber 1*b* smaller than in comparison with the example in FIG. 2A, and a deformation volume of the release layer 15 larger in comparison with the example in FIG. 2A. As a result, the fiber 1*b* can be more sufficiently covered.

It is conceivable that $E_{ITs}$ enlarged in comparison with the $E_{ITc}$ prevents the pressure applied to the surface of the fixing member in contact with the fiber 1*b* from acting on a localized spot of the flexible elastic layer 14. As a result, it is conceivable that the pressure applied to the fixing member is used for sufficiently deforming the release layer 15, allowing the release layer 15 to more reliably follow the fiber 1*b*.

The fixing member, the fixing device and the image forming apparatus according to an aspect of the present invention are described in detail based on a specific structure as follows.

Figure 3A:
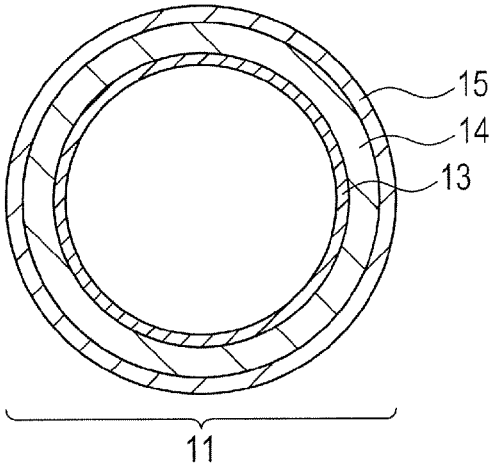
FIG. 3A is a schematic cross-sectional view illustrating a fixing belt according to an aspect of the present invention.
Figure 3B:
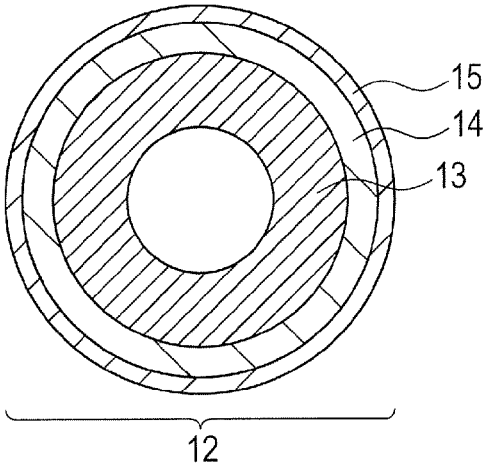
FIG. 3B is a schematic cross-sectional view illustrating a fixing roller according to an aspect of the present invention.

1. Fixing Member:

The fixing member according to an aspect of the present invention is described with reference to FIG. 3A and FIG. 3B. FIG. 3A and FIG. 3B represent examples of the fixing members, respectively. FIG. 3A is a schematic cross-sectional view illustrating a fixing belt 11, and FIG. 3B is a schematic cross-sectional view illustrating a fixing roller 12. The fixing member includes an elastic layer 14 which covers the circumference of a substrate 13, and a release layer 15 which covers the surface of the elastic layer 14. The release layer 15 may be fixed to the circumference of the elastic layer 14 with an adhesive layer (not shown in drawing) in some cases.

In general, a fixing member is referred to as a fixing belt when a fixing nip is formed by deformation of both of the elastic layer and the substrate itself, and referred to as a fixing roller when a fixing nip is formed by elastic deformation of the elastic layer with the substrate itself being hardly deformed. In order to obtain the effect according to an aspect of the present invention, the fixing member can be in a form of fixing belt.

(1) Substrate:

The substrate 13 is made from a metal and an alloy such as aluminum, iron, stainless steel, and nickel, and a heat-resistant resin such as polyimide.

A mandrel is used as the substrate 13 of a fixing member in a roller form. Examples of the material of the mandrel include a metal and an alloy such as aluminum, iron, and stainless steel. The mandrel may have a hollow or solid inside, as long as having a strength for withstanding the applied pressure in a fixing device. On this occasion, a hollow mandrel allows a heat source to be disposed therein.

Examples of the substrate 13 of a fixing member in a belt form include an electroformed nickel sleeve, a stainless sleeve, and a heat-resistant resin belt of polyimide. A layer for imparting functions such as abrasion resistance and thermal insulation (not shown in drawing) may be further provided on the inner face of the substrate 13.

The outer face of the substrate 13 may be subjected to surface treatment for imparting adhesion to the elastic layer 14. A physical treatment such as blasting, lapping, and grinding, and a chemical treatment such as oxidizing, coupling with an agent, and priming may be used in the surface treatment singly or in combination.

In particular, when a silicone rubber is used as an elastic layer, priming of the outer face of the substrate is generally performed in order to secure adhesion between the substrate and the elastic layer. The primer for use may be a coating material which contains a silane coupling agent, a silicone polymer, a hydrogenated methyl siloxane, an alkoxysilane, a reaction accelerating catalyst, and a colorant such as red iron oxide dispersed in an organic solvent with a proper compounding. A product on the market may be used as the primer. Priming may be performed by applying the primer on the surface of the substrate (bonding face to the elastic layer), and drying or firing the primer.

The primer may be appropriately selected corresponding to the material of the substrate, the type of the elastic layer, and the mode of the cross-linking reaction. In particular, when the elastic layer contains a large amount of unsaturated aliphatic groups, a primer which contains hydrosilyl groups is suitably used to imparting more adhesion through the reaction with the unsaturated aliphatic groups. In contrast, when the elastic layer contains a large amount of hydrosilyl groups, a primer which contains unsaturated aliphatic groups is suitably used. Other examples of the primer include a primer which contains alkoxy groups.

(2) Elastic Layer:

Preferred examples of the material for use in constituting the elastic layer include a heat-resistant rubber such as a silicone rubber and a fluorine rubber, and an addition-curable silicone rubber is particularly preferred. Because an addition-curable silicone rubber achieves easy dispersion of the below described filler in a composition before curing and the elastic modulus of the elastic layer can be adjusted by adjusting the degree of cross-linking through changes in the type and the addition volume of filler.

The thickness of the elastic layer may be appropriately designed considering the surface hardness of a fixing member and the nip width to be formed. A fixing member in a belt form has a thickness of the elastic layer of, preferably 100 μm or more and 500 μm or less, more preferably 200 μm or more and 400 μm or less. A fixing member in a roller form has a thickness of the elastic layer of, preferably 100 μm or more and 3 mm or less, more preferably 300 μm or more and 2 mm or less. With a thickness of the elastic layer in the range, the fixing member assembled into a fixing device can have a sufficient nip width secured by deformation of the elastic layer.

(2-1) Indentation Elastic Modulus:

The elastic layer has an indentation elastic modulus $E_{ITs}$ at a surface thereof and an indentation elastic modulus $E_{ITc}$ at a position in a depth of 50 μm from the surface, $E_{ITs}$ and $E_{ITc}$ being measured at a temperature of 150° C., and $E_{ITs}$ is larger than $E_{ITc}$ and $E_{ITc}$ is 17 MPa or more and 24 MPa or less. $E_{ITc}$ can be 20 MPa or more and 21 MPa or less.

With an $E_{ITc}$ of 24 MPa or less, the elastic layer has sufficient flexibility, so that the fixing member can satisfactorily follow relatively large irregularities lying on the surface of a sheet of paper such as rough paper.

With an $E_{ITc}$ less than 17 MPa, the elastic layer has excessive flexibility. Consequently, even with an indentation elastic modulus $E_{ITs}$ at the surface of the elastic layer enlarged in comparison with the indentation elastic modulus $E_{ITc}$ at a position in a depth of 50 μm from the surface, the pressure caused by the contact with the fiber cannot be sufficiently prevented from acting on a localized spot on the elastic layer.

Herein, although the value 150° C. is set as a representative value for the operating temperature of a typical fixing member, the present invention may be applied to any operation of the fixing member in the range of operation temperature other than 150° C., as a matter of course. Because the temperature dependency of the indentation elastic modulus of a silicone rubber constituting the elastic layer is small in the typical operation temperature range of a fixing member, for example, in the temperature range of 100° C. or higher and 190° C. or lower.

It is difficult for the surface of the fixing member to follow the relatively large irregularities lying, for example, on a rough paper surface, by the deformation of a thin release layer alone. Accordingly, the elastic deformation of a flexible elastic layer is required for the following performance. On this occasion, it is important that the indentation elastic modulus $E_{ITc}$ at a position in a depth of 50 μm from the surface of the elastic layer to lie in the range, such that the flexibility is achieved.

In addition, $E_{ITs}$ is larger than $E_{ITc}$. Namely, when $E_{ITc}$ and $E_{ITs}$ is equal, as described above with reference to FIG. 2A, it is difficult for a release layer of flexible PFA to be sufficiently deformed relative to the irregularities at the level of the fiber of plain paper. However, $E_{ITs}$ enlarged in comparison with $E_{ITc}$ allows the release layer to be deformed on a large scale.

$E_{ITs}$ is preferably 22 MPa or more and 31 MPa or less, more preferably 26 MPa or more and 28 MPa or less.

Further, $E_{ITc}$ and $E_{ITs}$ can satisfy a relation: $E_{ITs} \geq 1.3 \times E_{ITc}$. With $E_{ITc}$ and $E_{ITs}$ satisfying the relation, the release layer can more satisfactorily follow the irregularities at the level of the fiber of plain paper.

$E_{ITs}$ and $E_{ITc}$ (hereinafter, collectively referred to as "indentation elastic modulus $E_{IT}$" in some cases) may be measured by a microhardness measurement system (trade name: FISCHERSCOPE HM2000 XYp; manufactured by Fischer Instruments K.K.). The microhardness measurement is performed to understand the difference in the elastic modulus between at the surface and at a position in a depth of 50 μm from the surface of the same elastic layer.

The measurement is performed as follows using a sample cut out from a fixing member. A measurement apparatus uses a diamond Vickers indenter in a squared pyramid form with an angle of 136° between faces according to ISO 14577 as measurement head. The indenter is pressed into a depth of 20 μm from the surface of a sample at an indentation rate of 1 μm/s. The indented state is maintained for 5 seconds, and the load is removed at a rate of 1 μm/s. The indentation elastic modulus $E_{IT}$ is obtained from the slope of the load removing curve in load removing, as a load-displacement curve representing the relation between the load applied to the indenter and the displacement in the load range 65% to 95% of the maximum load, according to the following equation (1) specified in ISO 14577.

[Formula 1]

$$E_{IT} = \frac{1-(\nu_s)^2}{\frac{1}{E_r} - \frac{1-(\nu_i)^2}{E_i}} \quad (1)$$

$\nu_s$: Poisson's ratio of sample piece $\nu_i$: Poisson's ratio of indenter $E_r$: Reduced elastic modulus at indentation contact (elastic modulus with load removed)

$E_i$: Elastic modulus of indenter

In calculation of the indentation elastic modulus $E_{IT}$, the Poisson's ratio $\nu_s$ of a sample piece is assigned. When a silicone rubber is used as the elastic layer, a Poisson's ratio of 0.5 is used for the calculation.

The sample is fixed on an optional heating stage and the temperature of the surface of the sample is set to 150° C. before the measurement. The measurement method is described in detail in Examples.

(2-2) Manufacturing Method of Elastic Layer:

Taking an example of the case of using an addition-curable silicone rubber composition, the manufacturing method of an elastic layer is described as follows.

First, a cured material layer of silicone rubber composition which contains the below described materials is formed on a substrate. Subsequently, the surface of the cured material layer on the side which is to be adjacent to a release layer is processed to increase the elastic modulus of the surface, so that an elastic layer can be manufactured.

(2-2-1) Silicone Rubber Composition:

An addition-curable silicone rubber composition as raw material for forming the elastic layer includes the following fundamental components (a), (b), and (c):

(a) an organopolysiloxane having unsaturated aliphatic groups;

(b) an organopolysiloxane having active hydrogen bonded to silicon; and (c) a platinum compound as cross-linking catalyst.

Examples of the organopolysiloxane having unsaturated aliphatic groups as the component (a) include the following:

- a straight chain organopolysiloxane having both molecular ends represented by $R1_2R2SiO_{1/2}$ and intermediate units represented by $R1_2SiO$ and R1R2SiO;
- a branched chain organopolysiloxane having both molecular ends represented by $R1_2R2SiO_{1/2}$, including $R1SiO_{3/2}$ and/or $SiO_{4/2}$ as intermediate units.

Herein, R1 represents a mono-valent non-substituted or substituted hydrocarbon group including no aliphatic unsaturated group, which is bonded to a silicon atom. Specific examples thereof include an alkyl group (e.g. a methyl group, an ethyl group, an n-propyl group, an n-butyl group, an n-pentyl group and n-hexyl group), an aryl group (a phenyl group and a naphthyl group), and an substituted hydrocarbon group (e.g. a chloromethyl group, a 3-chloropropyl group, a 3,3,3-trifluoropropyl group, a 3-cyanopropyl group, and a 3-methoxypropyl group).

Due to the excellent heat resistance with easy synthesis and handling, in particular, R1 with a methyl group content of 50% or more is preferable, and R1 with a methyl group content of 100% is more preferable.

R2 represents an unsaturated aliphatic group bonded to a silicon atom. Examples of R2 include a vinyl group, an aryl group, a 3-butenyl group, a 4-pentenyl group, and a 5-hexenyl group. A vinyl group is particularly preferred due to easy cross-linking reaction of silicone rubber with easy synthesis and handling.

The organopolysiloxane having active hydrogen bonded to silicon as the component (b) is a cross-linking agent which forms a cross-linking structure by a reaction with the alkenyl group of the component (a) through the catalytic action of a platinum compound.

In the component (b), the number of the hydrogen atom bonded to a silicon atom can be 3 or more in a molecule on average. Examples of the organic group bonded to a silicon atom include the same substituted or non-substituted monovalent hydrocarbon group as R1 of the organopolysiloxane component having an unsaturated aliphatic group. Due to the easy synthesis and handling, a methyl group is particularly preferred. The molecular weight of the organopolysiloxane having active hydrogen bonded to silicon is not particularly limited.

The dynamic viscosity of the component (b) at 25° C. is preferably in the range of 10 $mm^2/s$ or more and 100,000 $mm^2/s$ or less, and more preferably in the range of 15 $mm^2/s$ or more and 1,000 $mm^2/s$ or less. With a dynamic viscosity of 10 $mm^2/s$ or more, the organopolysiloxane hardly volatizes during storage, so that a silicone rubber to be obtained can have a desired degree of cross-linking and physical properties. With a dynamic viscosity of 100,000 $mm^2/s$ or less, the organopolysiloxane can be easily dispersed in a system with easy handling.

The siloxane skeleton of the component (b) may be in a straight chain form, a branched chain form, or a cyclic form, and alternatively a mixture thereof may be used. From the viewpoint of easiness in synthesis, the siloxane skeleton in a straight form can be used.

Further, although Si—H bonds in the component (b) may exist in any siloxane unit in a molecule, at least a part of the bonds can exist at a molecular end of organopolysiloxane, as in an $R1_2HSiO_{1/2}$ unit.

Further, the components (a) and (b) are blended such that an addition-curable silicone rubber composition has a ratio of the number of unsaturated aliphatic groups relative to the number of silicon atoms of preferably 0.001 or more and 0.020 or less, more preferably 0.002 or more and 0.010 or less. Further, blending the components (a) and (b) is preferred so as to be a ratio of the number of active hydrogen relative to the number of unsaturated aliphatic groups of 0.3 or more and 0.8 or less. With a ratio of the number of active hydrogen relative to the number of unsaturated aliphatic groups of 0.3 or more, the silicone rubber after curing stably has a desired hardness. With a ratio of the number of active hydrogen relative to the number of unsaturated aliphatic groups of 0.8 or less, an excessive increase in the hardness of the silicone rubber can be prevented. The ratio of the number of active hydrogen relative to the number of unsaturated aliphatic groups can be calculated by the quantitative determination of the number of unsaturated aliphatic groups and the number of active hydrogen using hydrogen nuclear magnetic resonance analysis (1H-NMR (trade name: AL400 FT-NMR manufactured by JEOL Ltd.).

The addition-curable silicone rubber composition may further contain a filler in addition to the components (a) to (c). The filler is added in order to control the thermal conductivity, the heat resistance and the elastic modulus.

Specific examples of the filler are as follows: silicon carbide (SiC); silicon nitride ($Si_3N_4$); Silica ($SiO_2$); boron nitride (BN); aluminum nitride (AlN); alumina ($Al_2O_3$); ferric oxide ($Fe_2O_3$); zinc oxide (ZnO); magnesium oxide (MgO); titanium oxide ($TiO_2$); copper (Cu); aluminum (Al); silver (Ag); iron (Fe); nickel (Ni); carbon black (C); carbon fiber (C); and carbon nanotube (C).

To the addition-curable silicone rubber composition, a reaction control agent referred to as inhibitor may be further added in order to control the starting time of the reaction. Examples of the reaction control agent include a known material such as methylvinyltetrasiloxane, acetylene alcohols, an siloxane-modified acetylene alcohol, and a hydroperoxide.

(2-2-1) Manufacturing of Elastic Layer:

First, an addition-curable silicone rubber composition including the above described material is supported on the outer peripheral face of a substrate by a processing method such as molding, blade coating, nozzle coating, and ring coating, and heated for the progress of a cross-linking reaction, so that a layer of cured material of the addition-curable silicone rubber composition (herein after simply referred to as "cured material layer") is formed.

Herein, the filler content in the cured material layer is important for controlling $E_{ITc}$ in the range of 17 MPa or more and 24 MPa or less.

In order to control $E_{ITc}$ in the range, when a spherical filler is used as filler, the amount of the spherical filler in the cured material layer is preferably in the range of 20 vol % or more and 50 vol % or less, particularly preferably in the range of 30 vol % or more and 40 vol % or less, relative to the entire volume of the cured material layer.

When an irregular shape filler such as a plate-shaped filler or a needle-shaped filler is used as a filler, $E_{ITc}$ can be controlled in the range with a smaller content in comparison with a spherical filler. In order to control $E_{ITc}$ in the range, the content of an irregular shape filler can be appropriately set corresponding to the aspect ratio and the size of the irregular shape filler, and the degree of orientation of the irregular shape filler in an elastic layer relative to the longitudinal direction of the elastic layer. More specifically, $E_{ITc}$ can be enlarged by increasing the aspect ratio (=length/width) of the irregular shape filler, or increasing the degree of orientation of the irregular shape filler. The degree of orientation of an irregular shape filler is different depending on the manufacturing method and manufacturing conditions of the elastic layer.

When an elastic layer is formed by a known ring coating method, examples of the content of irregular shape filler are as follows. When a pitch carbon fiber (aspect ratio: 5 to 30, average length: 50 μm to 300 μm) is used as irregular shape filler in the elastic layer, the content of the pitch carbon fiber can be in the range of 10 vol % or more and 30 vol % or less relative to the entire volume of the cured material layer. When vapor phase growth carbon fiber (aspect ratio: 30 to 100, average length: 5 μm to 10 μm) is used as irregular shape filler, the content of the vapor phase growth carbon fiber can be in the range of 5 vol % or more and 10 vol % or less relative to the entire volume of the cured material layer. Alternatively, spherical filler and irregular shape filler may be used in combination in some cases as a filler. On this occasion, the content of the spherical filler is controlled to preferably in the range of 1 vol % or more and 5 vol % or less, particularly preferably in the range of 1 vol % or more and 3 vol % or less, and the content of the irregular shape filler is controlled to preferably in the range of 20 vol % or more and 50 vol % or less, particularly preferably in the range of 30 vol % or more and 40 vol % or less.

Further, $E_{ITc}$ can be enlarged by increasing the content of the filler in the cured material layer. $E_{ITc}$ can be also enlarged by increasing the proportion of irregular shape filler in the entire filler.

Subsequently, the surface of the cured material layer having $E_{ITc}$ of 17 MPa or more and 24 MPa or less on the side opposite to a release layer is processed, such that the indentation elastic modulus at the surface is enlarged in comparison with the $E_{ITc}$. Examples of the processing method for enlarging the indentation elastic modulus at the surface of the cured material layer include the following two methods.

(i) Method of Irradiating the Surface of the Cured Material Layer with UV Rays (Patent Literature 2):

The method allows the surface of the elastic layer to be partially oxidized with UV rays, so that cross-linking proceeds at the surface of the elastic layer, resulting in increase in the elastic modulus of the elastic layer.

From the UV light source for irradiation, UV rays having a wavelength of 185 nm can be irradiated. The UV rays having a wavelength of 185 nm decomposes oxygen molecules in the atmospheric air to create active oxygen. The cross-linking reaction of the elastic layer proceeds by the active oxygen created. Specific examples of the UV light source include a low-pressure mercury lamp.

The UV rays can be irradiated such that the accumulated amount of UV rays having a wavelength of 185 nm per unit area is controlled in the range of 300 mJ/cm$^2$ or more and 1000 mJ/cm$^2$ or less. The amount of UV irradiation can be measured by a meter for measuring the accumulated amount of UV rays (trade name: "C8026 H8025-185" manufactured by Hamamatsu Photonics K.K.).

(ii) Method of Applying a Silicone Polymer Having a Plurality of Hydrosilyl Groups Acting as a Cross-Linking Agent for an Addition-Curable Silicone Rubber in a Molecule onto the Surface of the Cured Material Layer and Heating the Silicone Polymer:

Examples of the silicone polymer include "SH1107" (trade name) manufactured by Dow Corning Toray Co., Ltd. In the method, the unsaturated aliphatic group of the addition-curable silicone rubber remaining unreacted in the vicinity of the surface of the cured material layer is reacted with the cross-linking agent, so that the cross-linking density at the surface of the cured material layer increases. In order to enlarge the indentation elastic modulus $E_{ITs}$ at the surface of the elastic layer in comparison with the $E_{ITc}$ at a position in a depth of 50 μm from the surface, adjustment of the application amount of the cross-linking agent is required, such that the cross-linking agent is prevented from permeating into the position in a depth of 50 μm from the surface. More specifically, the cross-linking agent is applied to the surface of the cured material layer, such that the thickness of the layer of the cross-linking agent to be applied to the surface of the cured material layer is controlled in the range of, preferably 0.1 μm or more and 5.0 μm or less, particularly preferably 0.5 μm or more and 2.5 μm or less.

The cross-linking agent thus applied to the surface of a cured material layer is reacted with the unsaturated aliphatic groups in the vicinity of the surface of the cured material layer, so that an elastic layer is obtained. On this occasion, the heating temperature can be about 130° C., and the heating time can be about 30 minutes as preferable conditions of the reaction.

(3) Release Layer:

A release layer includes a tetrafluoroethylene-perfluoroalkyl vinyl ether copolymer (PFA), having a content of perfluoroalkyl vinyl ether (PAVE) of 3.0 mol % or more and 5.8 mol % or less relative to the entire PFA in the release layer. The PAVE skeleton part inhibits crystallization of the polytetrafluoroethylene (PTFE) skeleton part, so that the crystallinity of the resin is reduced. Consequently, a PFA resin which contains PAVE in an amount of 3.0 mol % or more has a lowered glass transition temperature of resin with reduced crystallinity of the resin, in comparison with a conventional PFA resin which contains PAVE in amount less than 3.0 mol %. The PFA resin can be therefore in a more flexible rubber state in the vicinity of the operation temperature of a fixing member. As a result, it is conceivable that the followability to the irregularities present in a plain paper at the level of the diameter of paper fiber is improved.

In the present invention, the PFA resin contained in the release layer may be a mixture of a plurality of PFA. Namely, the ratio of PAVE relative to the entire PFA in the release layer does not necessarily mean the copolymerization ratio of PFA.

Examples of the PAVE include perfluoro(methyl vinyl ether) (PMVE), perfluoro(ethyl vinyl ether) (PEVE), and perfluoro(propyl vinyl ether) (PPVE), and PEVE can be used due to the easiness of synthesis.

A known method can be used for synthesizing PFA, and PFA can be synthesized by a method described in Patent Literature 3. Alternatively various products on the market may be used. Examples of the product on the market include "TEFLON (registered trade mark) PFA959HP-Plus" (trade name) manufactured by Du Pont-Mitsui Fluorochemicals Co., Ltd.

Examples of the method for forming the release layer include a method for covering an elastic layer with a tube-shaped molding by extruding. Other examples of the method for forming the release layer include a method of coating the surface of an elastic layer with a fine particle of a fluorine resin or a coating material which contains a fine particle of a fluorine resin dispersed in a solvent, and subsequently drying, melting and baking it (a coating method).

The thickness of the release layer is preferably 5 μm or more and 50 μm or less, more preferably 10 μm or more and 30 μm or less. The reason is as follows. With a thickness of 5 μm or more, the release layer can be easily formed, and with a thickness of 50 μm or less, good heat conductivity from a fixing member to a sheet of paper can be achieved.

The elastic layer and the release layer may be bonded through an adhesive layer not shown in drawing in some cases. When an elastic layer is covered with a tube-shaped molding fluorine resin to form a release layer, a thermosetting silicone rubber adhesive may be suitably used as the adhesive layer. Further, when a release layer is formed by the coating method, a primer conditioned in a coating material form is applied to the surface of the elastic layer and dried, which is then coated with a fluorine resin-containing coating material to be dried and melted, so that adhesion can be achieved.

2. Fixing Device:

A fixing device includes a pair of heated rotating bodies such as a roller and a roller, a film and a roller, a belt and a roller, a belt and a belt which are pressure-contacted, from which a proper one is selected considering the conditions such as the processing speed and the size of the entire electrophotographic image forming apparatus. The structure thereof is described as follows, with reference to specific Examples of the fixing device.

Figure 5:
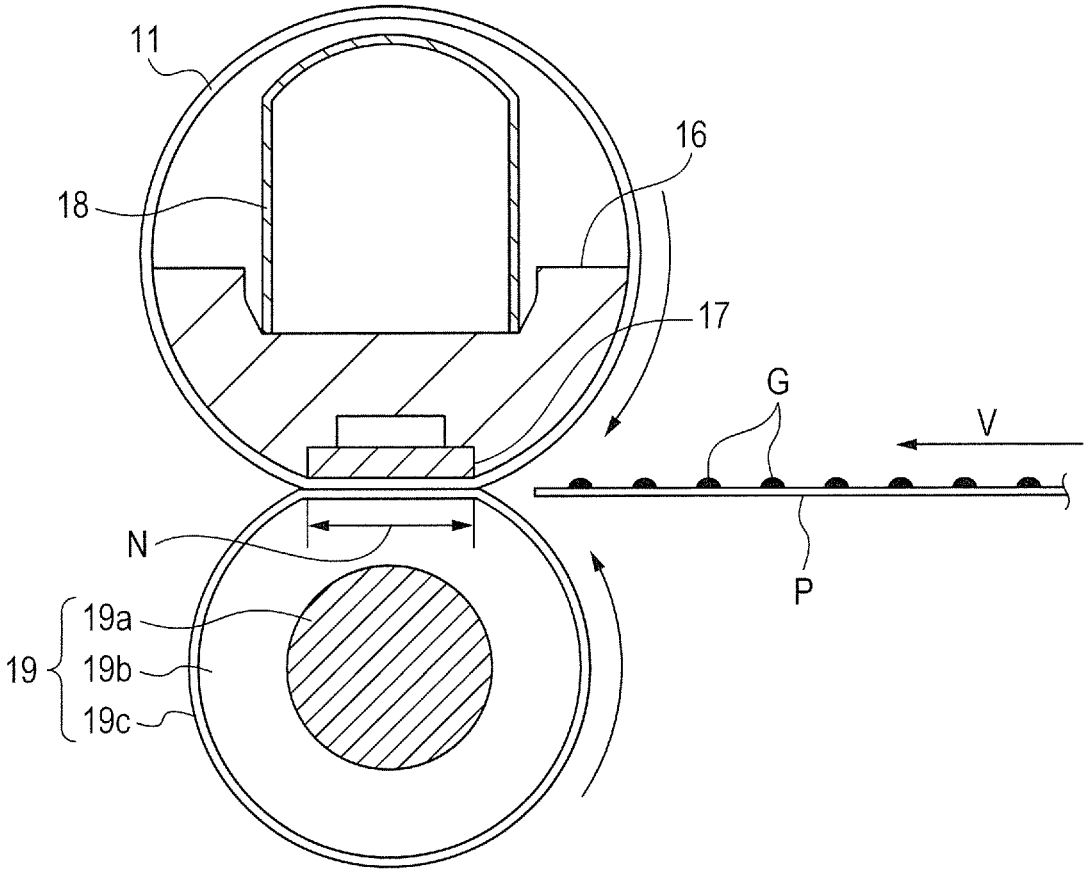
FIG. 5 is a cross-sectional view illustrating an example of the fixing device using a fixing belt according to an aspect of the present invention.

(1) Fixing Device Using a Fixing Member in a Belt Form:

In FIG. 5, a schematic cross-sectional view in the lateral direction of an example of the fixing device using a fixing member in a belt form is illustrated.

In the fixing device, a fixing belt 11 has a seamless form (endless form) as the fixing member according to an aspect of the present invention. In order to hold the fixing belt 11, a belt guide member 16 formed of a resin having heat resistance and thermal insulating properties is provided.

At the position where the belt guide member 16 comes in contact with the inner face of the fixing belt 11, a ceramic heater 17 as thermal source is provided.

The ceramic heater 17 is fitted in a groove part formed along the longitudinal direction of the belt guide member 16 so as to be fixed and supported. The ceramic heater 17 is energized to generate heat by a unit not shown in drawing.

The fixing belt 11 in a seamless form is loosely fitted onto the belt guide member 16. A rigid stay 18 for applying pressure is inserted inside of the belt guide 16.

An elastic pressure roller 19 as member for applying pressure includes a stainless steel mandrel 19*a* having an elastic layer 19*b* of silicone rubber for lowering the surface hardness.

Both of the ends of the mandrel 19*a* are rotatably supported between the chassis side plates (not shown in drawing) on front and rear sides of the fixing device.

An elastic pressure roller 19 is covered with a fluorine resin tube with a thickness of 50 μm as a surface layer 19*c* for improving the surface properties and the releasability.

Pressure springs (not shown in drawing) in a compressed state are disposed between both ends of the rigid stay 18 for applying pressure and a spring receiving member (not shown in drawing) on the side adjacent to the chassis of the device, respectively, so that a depressing force is imparted to the rigid stay 18 for applying pressure. The lower face of the ceramic heater 17 disposed at the lower face of the belt guide member 16 and the top face of the pressure member 19 are thereby pressure-contacted across the fixing belt 11, so that a prescribed fixing nip N is formed.

A recording medium P to be heated, on which an image is formed of unfixed toner G, is held and transported by the fixing nip N at a transportation speed V. The toner image is thereby heated under pressure. As a result, the toner image is melted, color-mixed, and then cooled to be fixed on the recording medium P.

Figure 6:
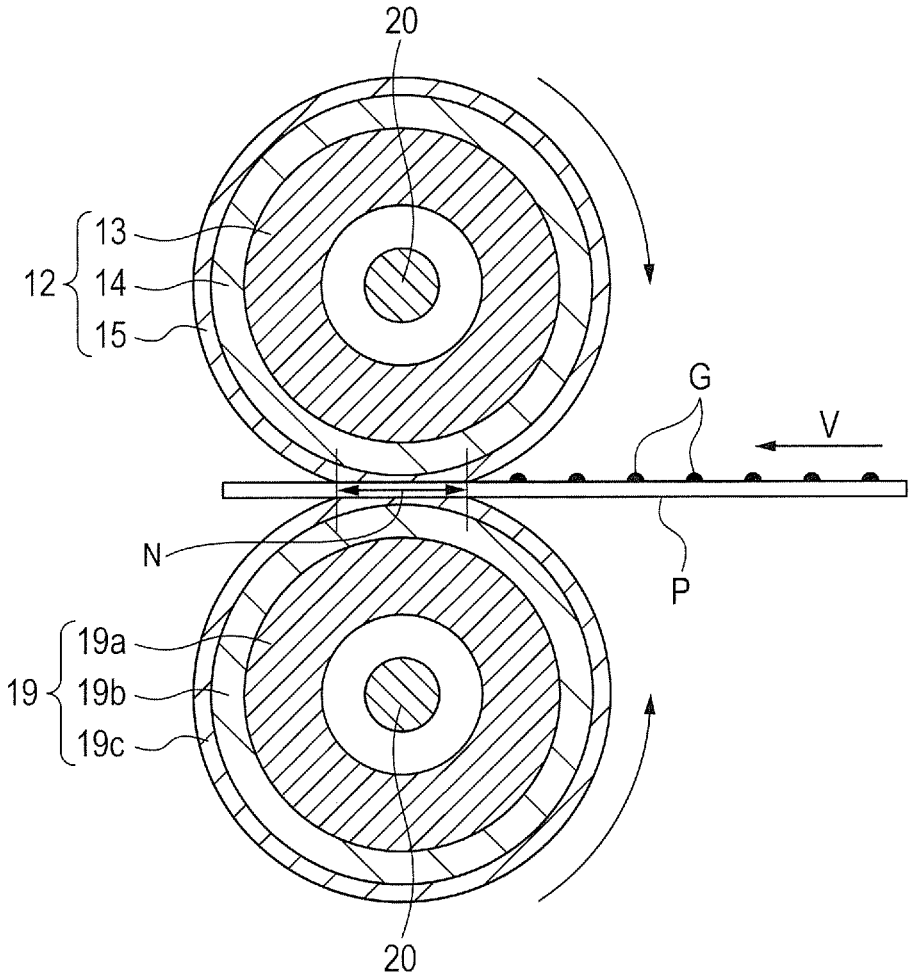
FIG. 6 is a cross-sectional view illustrating an example of the fixing device using a fixing roller according to an aspect of the present invention.

(2) Fixing Device Using a Fixing Member in a Roller Form:

In FIG. 6, a schematic cross-sectional view in the lateral direction of an example of the fixing device using a fixing member in a roller form is illustrated according to an aspect of the present invention.

In the fixing device, a fixing roller 12 is the fixing member according to an aspect of the present invention. The fixing roller 12 includes an elastic layer 14 formed on the outer peripheral face of a substrate 13, and a release layer 15 formed on the outer side of the elastic layer 14.

An elastic pressure roller 19 as pressure member is disposed opposite to the fixing roller 12, and the two rollers are rotatably compressed by a pressure unit not shown in drawing so as to form a fixing nip N.

Heaters 20 as heat sources for supplying the necessary heat to melt an unfixed toner G are disposed inside of the fixing roller 12 and the elastic pressure roller 19, respectively. A halogen heater is typically used as the heater 20. A plurality of halogen heaters may be disposed inside corresponding to the size of the recording medium P to be transported in some cases.

A rotating force is imparted to the fixing roller 12 and the elastic pressure roller 19 through the ends of the substrate 13 and the mandrel 19*a* by a unit not shown in drawing, and the rotation is controlled such that the moving speed of the surface of the fixing roller 12 is approximately equalized to the transportation speed V of the recording medium. On this occasion, the rotating force may be imparted to any one of the fixing roller 12 and the elastic pressure roller 19 with another one driven to rotate, or may be imparted to both.

The fixing nip N thus formed in a fixing device holds and transports the recording medium P having an image formed of unfixed toner G thereon to be heated. The toner image is thereby heated under pressure. As a result, the toner image is melted, color-mixed, and cooled to be fixed on the recording medium.

3. Image Forming Apparatus:

Examples of the image forming apparatus include a multi-function machine, a copier, a facsimile machine, and a printer using electrophotography. Herein, with reference to the example of a color laser printer, the entire configuration of an image forming apparatus is overviewed.

Figure 7:
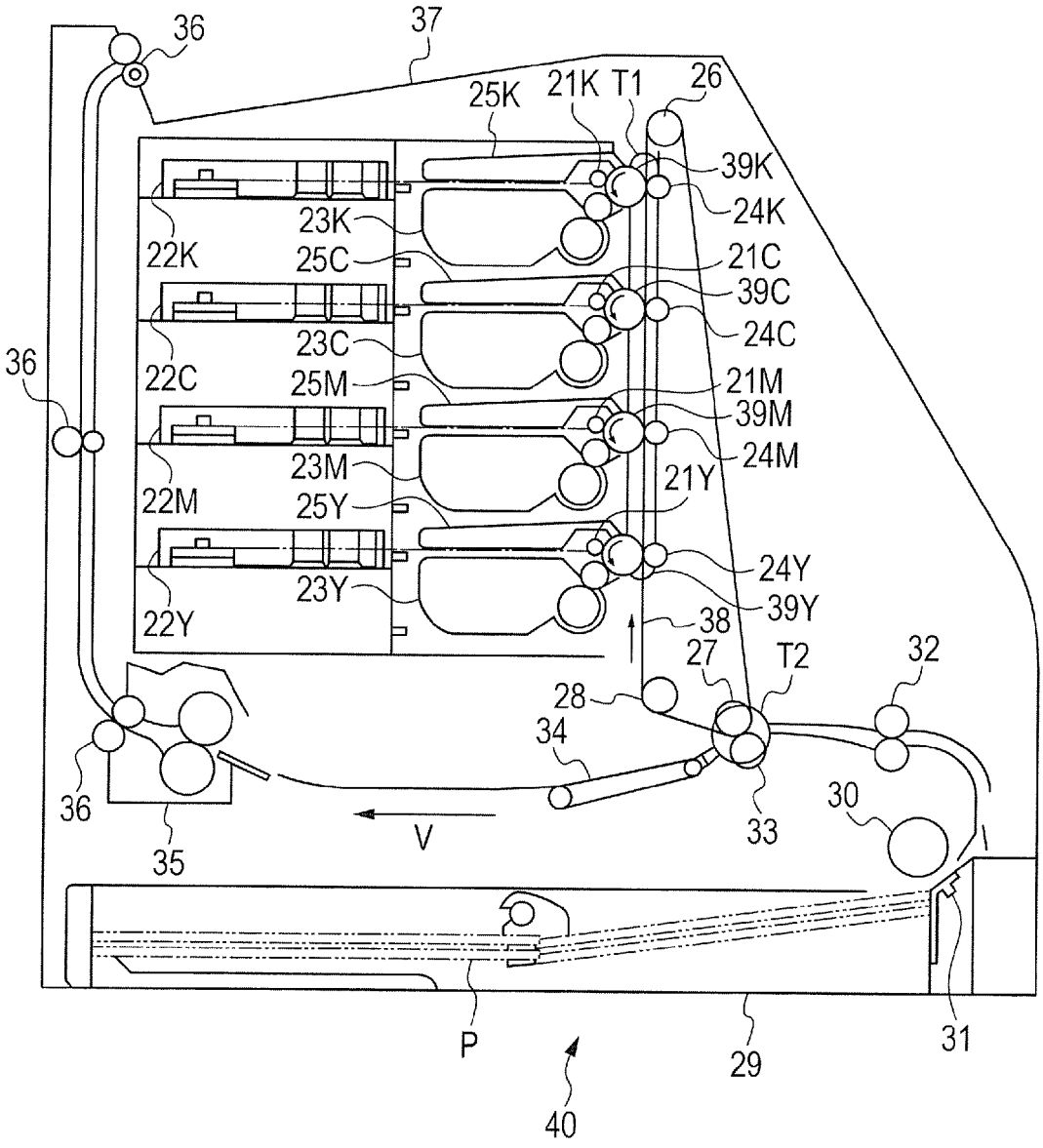
FIG. 7 is a schematic cross-sectional view illustrating an example of the image forming apparatus according to an aspect of the present invention.

FIG. 7 is a schematic cross-sectional view illustrating a color laser printer according to an aspect of the present invention.

A color laser printer (hereinafter referred to as "printer") 40 illustrated in FIG. 7 has an image forming part provided with an electrophotographic photosensitive drum (hereinafter referred to as "photosensitive drum") rotating at a constant speed for each of the colors yellow (Y), magenta (M), cyan (C), and black (K). The printer is also provided with an intermediate transfer body 38 which holds a color image developed and multiple-transferred in an image forming part and further transfers the image onto a recording medium P fed from a feeding part.

A photosensitive drum 39 (39Y, 39M, 39C and 39K) is rotary driven in the anti-clockwise direction by drive unit (not shown in drawing) as illustrated in FIG. 7.

Around the circumference of the photosensitive drum 39, a charging device 21 (21Y, 21M, 21C and 21K) which uniformly charges the surface of the photosensitive drum 39, a scanner unit 22 (22Y, 22M, 22C and 22K) which emits a laser beam based on image data so as to form an electrostatic latent image on the photosensitive drum 39, a developing unit 23 (23Y, 23M, 23C and 23K) which allows the toner to be stuck on the electrostatic latent image for development of the toner image, a primary transfer roller 24 (24Y, 24M, 24C and 24K) which transfers the toner image on the photosensitive drum 39 onto an intermediate transfer body 38 in a primary transfer part T1, and a cleaning unit 25 (25Y, 25M, 25C and 25K) which has a cleaning blade for removing the post-transfer residual toner on the surface of the photosensitive drum 39 after transfer, are sequentially disposed in the rotation direction.

On the occasion of image formation, the intermediate transfer body 38 in a belt form extending in a tensioned state on the rollers 26, 27 and 28 rotates, and each of the toner images formed on each of the photosensitive drum 39 is concurrently primarily transferred to the intermediate transfer body 38 in a superimposed manner for the formation of a colored image.

In synchronization with the primary transfer to the intermediate transfer body 38, the recording medium P is transported to a secondary transfer part T2 by a transportation unit. The transportation unit includes a feeding cassette 29 which accommodates a plurality of sheets of the recording media P, a feeding roller 30, a separation pad 31, and a register roller pair 32. When an image is formed, the feeding roller 30 is rotary driven corresponding to an image formation action for separation of the sheets of recording media P in the feeding cassette 29 one by one, and the sheet is transported to the secondary transfer part T2 by the register roller pair 32 in synchronization with the image formation action.

The secondary transfer part T2 is provided with a movable secondary transfer roller 33. The secondary transfer roller 33 is movable in an approximately vertical direction. When an image is transferred, the secondary transfer roller 33 is pressed onto the intermediate transfer body 38 at a prescribed pressure through the recording medium P. On this occasion, a bias is concurrently applied to the secondary transfer roller 33, so that the toner image on the intermediate transfer body 38 is transferred to the recording medium P.

The intermediate transfer body 38 and the secondary transfer roller 33 are each driven, so that the recording medium P inserted between both of them is transported toward the left arrow direction illustrated in FIG. 7 at a transportation speed V, and further transported to a fixing part 35 for the next step by a transportation belt 34. In the fixing part 35, the transferred toner image is fixed on the recording medium P by heating under pressure. The recording medium P is discharged onto a discharge tray 37 on the upper face of the apparatus by a discharge roller pair 36.

Using the fixing device according to an aspect of the present invention illustrated in FIG. 5 and FIG. 6 in the fixing part 35 of the electrophotographic image forming apparatus illustrated in FIG. 7, an image forming apparatus capable of providing a high-quality image excellent in the evenness of the image can be obtained.

EXAMPLE

With reference to Examples, the present invention is more specifically described as follows.

Example A-1

(1) Preparation of Fluorine Resin Tube:

From a fluorine resin pellet a (trade name: "TEFLON (registered trade mark) PFA959HP-Plus" manufactured by Du Pont-Mitsui Fluorochemicals Co., Ltd.), a fluorine resin tube having a length of 400 mm, an inner diameter of 29 mm, and a thickness of 20 μm was manufactured by extruding for use as the fluorine resin tube in the present Examples.

The fluorine resin pellet a includes tetrafluoroethylene-perfluoroalkyl vinyl ether copolymer (PFA), and the copolymer contains 4.3 mol % of perfluoro(ethyl vinyl ether) (PEVE) as perfluoroalkyl vinyl ether (PAVE) relative to the tetrafluoroethylene-perfluoroalkyl vinyl ether copolymer (PFA).

The proportion of the perfluoroalkyl vinyl ether (PAVE) in PFA was obtained from the measurement of NMR spectrum of $^{19}$F nucleus (trade name: DSX400, manufactured by Bruker BioSpin K.K.). The measurement was performed under room temperature environment, under conditions at an MAS frequency of 30 kHz and a cumulative number of 256.

Figure 8:
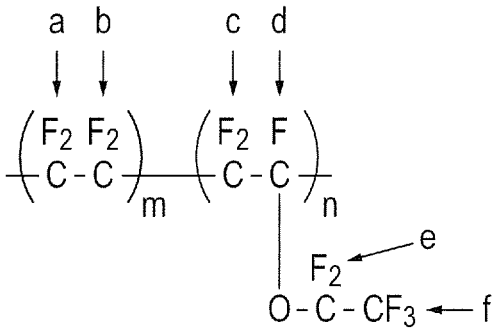
FIG. 8 illustrates the structural formula of PFA.

For example, PFA which is a copolymer of TFE and PEVE has 6 types of fluorine atoms a to f with a different environment as illustrated in FIG. 8. Among these, the fluorine atoms being attributed to a, b and c have observable peaks in the vicinity of −110 to −130 ppm in $^{19}$F-NMR. In contrast, the fluorine atoms being attributed to e and f have observable peaks in the vicinity of −80 to −90 ppm. From the peak area ratio between the two, the polymerization ratio of PEVE corresponding to n was calculated.

(2) Formation of Elastic Layer:

An endless sleeve made of electroformed nickel with an inner diameter of 30 mm, a width of 400 mm, and a thickness of 40 μm, having a surface processed with a primer was prepared as a substrate.

An addition-curable liquid silicone rubber including no filler (trade name: "SE1886", manufactured by Dow Corning Toray Co., Ltd.) was prepared as the raw material for forming an elastic layer. To 61 parts by volume of the liquid silicone rubber, 38 parts by volume of spherical alumina (trade name: "ALUNABEADS CB-A30S", manufactured by Showa Denko K.K.) as spherical filler, and 1 part by volume of vapor phase carbon fiber (trade name: "VGCF-S", manufactured by Showa Denko K.K., aspect ratio: 10, average fiber length: 10 μm) as irregular shape filler were added. An addition-curable silicone rubber composition for forming an elastic layer was thus prepared. The mixture was applied to the outer peripheral face of the endless sleeve made of electroformed nickel by ring coating, and then heated at a temperature of 200° C. for hours, so that the layer of the addition-curable silicone rubber composition was cross-linked to form a cured material layer having a thickness of 300 μm.

While the endless sleeve having the cured material layer was rotated at a moving speed of 20 mm/sec in the peripheral direction, the surface of the cured material layer was irradiated with UV rays under atmosphere with a UV lamp disposed at a position 10 mm away from the surface of the cured material layer. Using a low-pressure mercury UV lamp (trade name: GLQ500US/11, manufactured by Toshiba Lighting & Technology Corporation, (formerly known as Harison Toshiba Lighting Corporation)) as the UV lamp, the accumulated amount of UV rays having a wavelength of 185 nm at the irradiated surface was controlled at 800 mJ/cm$^2$. An elastic layer having $E_{ITs}$ larger than $E_{ITc}$ was thereby formed.

(3) Manufacturing of Fixing Belt:

Subsequently, an addition-curable silicone rubber adhesive (trade name: "SE1819CV", equal volume mixture of "LIQUID A" and "LIQUID B" manufactured by Dow Corning Toray Co., Ltd.) was approximately uniformly applied to the surface of the elastic layer so as to have a thickness of approximately 20 μm. In the configuration of the present Example, the irradiation of UV rays has an effect for preventing the increase in the hardness of the elastic layer due to permeation of the adhesive for bonding the release layer and the elastic layer into the elastic layer.

Subsequently, the belt was covered with the fluorine resin tube manufactured in the above (1) as the release layer. The belt surface was uniformly rubbed from the top of the resin tube, so that an excessive adhesive was discharged from between the elastic layer and the resin tube by the rubbing.

The endless sleeve was then heated in an electric oven set at 200° C. for 1 hour, so that the fluorine resin tube was bonded and fixed on the elastic layer with the adhesive cured. Both ends of the obtained endless belt were cut, so that a fixing belt with a width of 343 mm was obtained.

(4) Indentation Elastic Modulus of Elastic Layer:

$E_{ITs}$ and $E_{ITc}$ of the fixing belt manufactured in the above (3) were measured by the following method.

First, a sample with a length of 2 cm and a width of 2 cm was cut out from the manufactured fixing belt, and the release layer formed on the surface was removed by a surface removal unit such as cryomicrotome, so that a sample having an exposed surface part of the elastic layer was prepared.

Further, a portion ranging from the surface of the elastic layer to a depth of 50 μm from the surface of the elastic layer was removed by the same method, so that a sample having an exposed surface at a depth of 50 μm from the surface of the elastic layer was also manufactured.

The two sample thus manufactured were fixed on an optional heating stage of a microhardness measurement system (trade name: FISCHERSCOPE HM2000 XYp; manufactured by Fischer Instruments K.K.), and the temperature of the surface of the samples was set to 150° C. The measurement apparatus used a diamond Vickers indenter in a squared pyramid form with an angle of 136° between faces according to ISO 14577 as measurement head. The indenter was pressed into a depth of 20 μm from the surface of the sample at an indentation rate of 1 μm/s. The indented state was maintained for 5 seconds, and the load was removed at a rate of 1 μm/s. Each of the indentation elastic moduli was obtained from the load curve in load removing as a load-displacement curve representing the relation between the load and the displacement as described above.

Measurement was performed by the above described method for arbitrary 10 points of the sample having an exposed surface of the elastic layer, and $E_{ITs}$ was obtained from the average thereof. Further, measurement was also performed for arbitrary 10 points of the sample having an exposed surface at a depth of 50 μm from the surface of the elastic layer, and $E_{ITc}$ was obtained from the average thereof.

The measurement result of each of the indentation elastic moduli of the fixing belt showed that $E_{ITs}$ was 26 MPa and $E_{ITc}$ was 20 MPa.

Figure 4:
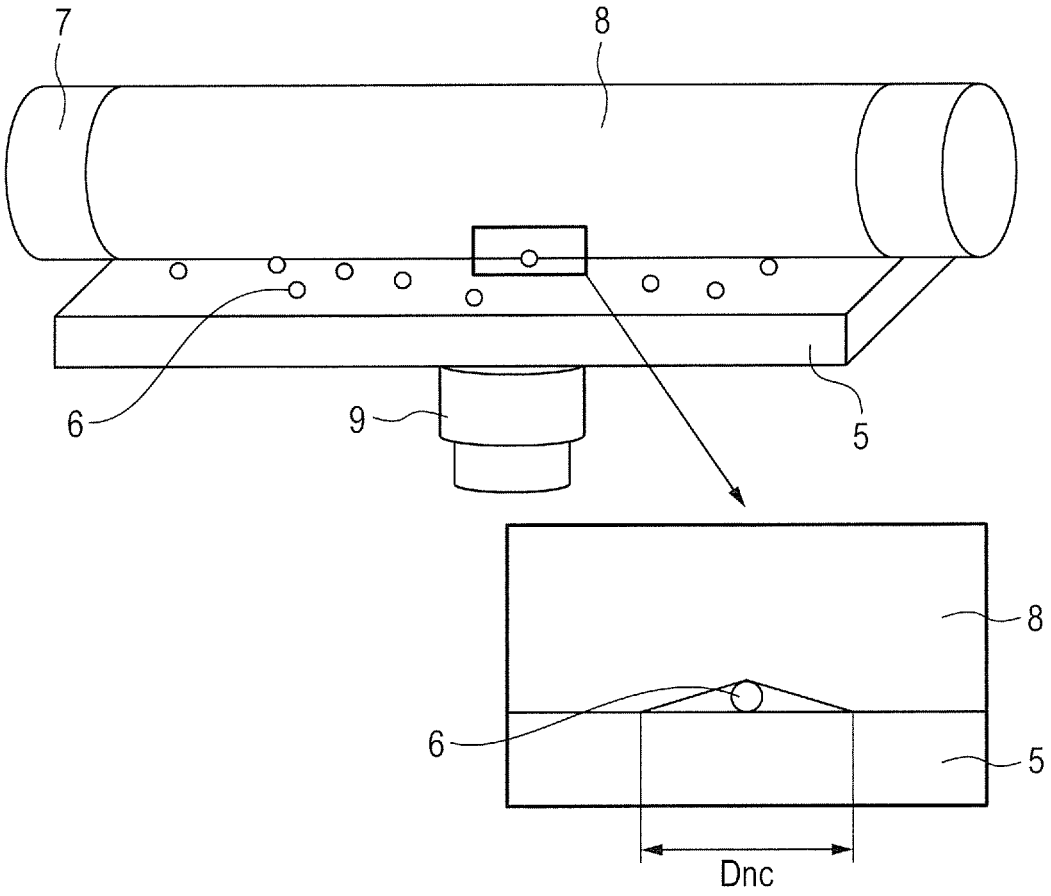
FIG. 4 is a schematic view illustrating a method for measuring the diameter in non-close contact state.

(5) Diameter in Non-Close Contact State of Alumina Particle:

In order to evaluate the followability of a fixing member to the irregularities at the level of the fiber diameter of pulp which composes a plain paper, the present inventors made a model as illustrated in FIG. 4 so as to evaluate the followability of the fixing member to the irregularities at the level of the fiber diameter of a plain paper.

With reference to FIG. 4, the model is described as follows. A spherical alumina particle 6 (manufactured by Showa Denko K.K., trade name: "ALUNABEADS CB-A20S", classified product) having a diameter of 20 μm to simulate the size equivalent to the paper fiber was scattered on a glass plate 5, such that no aggregation with each other occurred. Subsequently, a heating core 7 was inserted inside of the fixing belt 8. The fixing belt 8 was contacted with a glass plate 5 at a pressure of 0.2 MPa by a unit not shown in drawing. The fixing belt 8 was heated at 150° C. by the heating core 7. In the observation of the vicinity of contact region between the alumina particle 6 and the fixing belt 8 in the state by an observation unit 9 such as a microscope from the principal plane of the glass plate 5 on the side opposite to the side contacting with the fixing belt 8, a portion with the fixing member 8 and the glass plate 5 in a non-close contact state in an approximately circular form was observed around the alumina particle 6. The diameter of the circular portion in a non-close contact state was measured for each of 10 alumina particles. The arithmetic mean thereof was defined as "diameter $D_{nc}$ in a non-close contact state". It can be said that the followability to the irregularities at the level of the diameter of paper fiber increases as the diameter $D_{nc}$ in a non-close contact state decreases. In the present Examples, an optical microscope (trade name: DIGITAL MICROSCOPE VHX-2000, manufactured by Keyence Corporation) was used as the observation unit. As a result, the diameter $D_{nc}$ in a non-close contact state of the fixing belt was 82 μm.

(6) Evaluation on Followability to Surface Irregularities of Rough Paper:

When the followability to relatively large irregularities on a rough paper surface is not sufficient, unevenness in glossiness occurs in the image outputted from an image forming apparatus. The phenomenon is notably observed in a solid image which has a large amount of a toner placed on a unit area.

The followability of a fixing member to the irregularities present on a rough paper was, therefore, evaluated depending on whether the unevenness in glossiness occurred or not in a solid image formed on a rough paper.

The manufactured fixing belt was mounted on an electrophotographic image forming apparatus (trade name: imageRUNNER-ADVANCE C5051, manufactured by Canon Inc.), and an image including a secondary color of a cyan toner and a magenta toner was formed on approximately the entire surface of an A4 size rough paper (trade name: BUSINESS 4200, manufactured by Xerox Corporation, thickness: 102 μm, basis weight: 75 g/m$^2$, arithmetic mean of waviness Wa: 2.3 μm) at a density of 100%. The image was used for evaluation and visually observed by 5 research participants to determine whether the unevenness in glossiness occurred or not in the image.

The evaluation results are described in Table 2. The evaluation criteria in Table 2 are as follows:

Rank A: 4 or more in 5 research participants determined that there existed little unevenness in glossiness;

Rank B: 3 in 5 research participants determined that there existed little unevenness in glossiness; and Rank C: 2 or less in 5 research participants determined that there existed little unevenness in glossiness.

The arithmetic mean of waviness Wa of a rough paper is an index for measuring the degree of irregularities present on a paper surface. The arithmetic mean of waviness Wa was obtained as described below.

Using a surface roughness measuring device (trade name: SURFCORDER SE 3500, manufactured by Kosaka Laboratory Ltd.), the image forming surface was measured 5 times at arbitrary positions, with measurement conditions set at an evaluation length of 50 mm and a cut-off value of 0.8 to 8 mm. The arithmetic mean thereof was defined as the arithmetic mean of waviness Wa.

(7) Evaluation of Followability to Irregularities at the Level of the Diameter of Paper Fiber of Plain Paper:

Subsequently, using the same device, the image on a plain paper was evaluated for the manufactured fixing belt.

A black toner image was formed on approximately the entire surface of an A4 size printing paper (high white paper sheet GF-0081, manufactured by Canon Inc, thickness: 93 μm, basis weight: 81 g/m$^2$, arithmetic mean of waviness Wa: 1.0 μm) at a density of 50%. The image was used for evaluation and visually observed by 5 research participants to determine whether the unevenness in density occurred or not in the image based on the following criteria. The evaluation results are described in Table 2.

Rank A: 4 or more in 5 research participants determined that there existed little unevenness in density;

Rank B: 3 in 5 research participants determined that there existed little unevenness in density; and Rank C: 2 or less in 5 research participants determined that there existed little unevenness in density.

Examples A-2 to 4, and Comparative Examples A-1 to 4

Except that the content of each filler was changed as described in the following Table 1 so as to change $E_{ITc}$, a fixing belt was manufactured by the same procedures as in Example A-1 for evaluation. In Comparative Example A-4, however, the elastic layer was not irradiated with UV rays prior to the formation of the release layer. Evaluation results are described in Table 2.

Comparative Examples B-1 to 7

Using a fluorine resin pellet b (trade name: TEFLON (registered trade mark) PFA451HP-J, manufactured by Du Pont-Mitsui Fluorochemicals Co., Ltd.), a fluorine resin tube having a length of 400 mm, an inner diameter of 29 mm, and a thickness of 20 μm was manufactured by extruding.

The fluorine resin pellet b includes tetrafluoroethylene-perfluoroalkyl vinyl ether copolymer (PFA), and the copolymer contains 1.2 mol % of perfluoro(propyl vinyl ether) (PPVE) as perfluoroalkyl vinyl ether (PAVE) relative to the tetrafluoroethylene-perfluoroalkyl vinyl ether copolymer (PFA).

Except that the fluorine resin tube was used and an addition-curable silicone rubber composition with a filler content changed as described in the following Table 1 was used to form the elastic layer, a fixing belt was manufactured in the same way as in Example A-1 for evaluation. The evaluation results are described in Table 2.

Example C-1

(1) Preparation of Fluorine Resin Pellet c:

The fluorine resin pellet a and a fluorine resin pellet e (trade name: TEFLON (registered trade mark) PFA950HP Plus, manufactured by Du Pont-Mitsui Fluorochemicals Co., Ltd.) with a ratio of 13:87 were melted, kneaded, and extruded to manufacture a fluorine resin pellet c.

The fluorine resin pellet e for use includes tetrafluoroethylene-perfluoroalkyl vinyl ether copolymer (PFA), and the copolymer contains 2.8 mol % of perfluoro(propyl vinyl ether) (PPVE) as perfluoroalkyl vinyl ether (PAVE) relative to the tetrafluoroethylene-perfluoroalkyl vinyl ether copolymer (PFA).

It was confirmed that the fluorine resin pellet c contained 3.0 mol % of perfluoro(ethylvinyl ether) (PEVE) as perfluoroalkyl vinyl ether (PAVE) in the resin from the measurement of $^{19}$F nucleus by a nuclear magnetic resonance apparatus.

(2) Manufacturing of Fixing Belt:

Using the fluorine resin pellet c, a fluorine resin tube having a length of 400 mm, an inner diameter of 29 mm, and a thickness of 20 μm was manufactured by extruding. Except that the fluorine resin tube was used, a fixing belt was manufactured by the same way as in Example A-1 for evaluation. The evaluation results are described in Table 2.

Example C-2

Except that an addition-curable silicone rubber composition with a filler content changed as described in the following Table 1 was used in forming an elastic layer, a fixing belt was manufactured by the same way as in Example C-1 for evaluation. The evaluation results are described in Table 2.

Example D-1

A fluorine resin pellet d as raw material of the release layer was manufactured by the method described in Patent Literature 3, and a fluorine resin tube having a length of 400 mm, an inner diameter of 29 mm, and a thickness of 20 μm was molded by extruding. The fluorine resin pellet d includes tetrafluoroethylene-perfluoroalkyl vinyl ether copolymer (PFA), and it was confirmed that the copolymer contained 5.8 mol % of perfluoro(ethyl vinyl ether) (PEVE) as perfluoroalkyl vinyl ether (PAVE) relative to the tetrafluoroethylene-perfluoroalkyl vinyl ether copolymer (PFA) from the measurement of $^{19}$F nucleus by a nuclear magnetic resonance apparatus.

Except that a fluorine resin tube was used, a fixing belt was manufactured by the same way as in Example A-1 for evaluation. The results are described in Table 2.

Example D-2

Except that an addition-curable silicone rubber composition with a filler content changed as described in the following Table 1 was used in forming the elastic layer, a fixing belt was manufactured by the same way as in Example D-1 for evaluation. The results are described in Table 2.

TABLE 1

| | Addition-curable silicone rubber [vol %] | Spherical alumina [vol %] | Vapor phase growth carbon fiber [vol %] |
|---|---|---|---|
| Example A-1 | 61 | 38 | 1 |
| Example A-2 | 64 | 35 | 1 |
| Example A-3 | 67 | 31 | 2 |
| Example A-4 | 67 | 30 | 3 |

TABLE 1-continued

| | Addition-curable silicone rubber [vol %] | Spherical alumina [vol %] | Vapor phase growth carbon fiber [vol %] |
|---|---|---|---|
| Comparative Example A-1 | 84 | 15 | 1 |
| Comparative Example A-2 | 74 | 25 | 1 |
| Comparative Example A-3 | 52 | 46 | 2 |
| Comparative Example A-4 | 47 | 50 | 3 |
| Comparative Example B-1 | 84 | 15 | 1 |
| Comparative Example B-2 | 74 | 25 | 1 |
| Comparative Example B-3 | 64 | 35 | 1 |
| Comparative Example B-4 | 61 | 38 | 1 |
| Comparative Example B-5 | 67 | 31 | 2 |
| Comparative Example B-6 | 67 | 30 | 3 |
| Comparative Example B-7 | 52 | 46 | 2 |
| Example C-1 | 61 | 38 | 1 |
| Example C-2 | 67 | 31 | 2 |
| Example D-1 | 61 | 38 | 1 |
| Example D-2 | 67 | 31 | 2 |

TABLE 2

| | Indentation elastic modulus $E_{ITs}$ [MPa] | Indentation elastic modulus $E_{ITc}$ [MPa] | $E_{ITs}/E_{ITc}$ | Fluorine resin pellet type | Copolymer PAVE type | Proportion of PAVE [mol %] | Diameter in non-close contact state [μm] | Evaluation results on unevenness in glossiness on rough paper | Evaluation results on unevenness in density on plain paper |
|---|---|---|---|---|---|---|---|---|---|
| Example A-1 | 26 | 20 | 1.3 | a | PEVE | 4.3 | 82 | A | A |
| Example A-2 | 22 | 17 | 1.3 | a | PEVE | 4.3 | 98 | A | B |
| Example A-3 | 28 | 21 | 1.3 | a | PEVE | 4.3 | 78 | A | A |
| Example A-4 | 31 | 24 | 1.3 | a | PEVE | 4.3 | 74 | B | A |
| Comparative Example A-1 | 11 | 10 | 1.1 | a | PEVE | 4.3 | 148 | A | C |
| Comparative Example A-2 | 17 | 14 | 1.2 | a | PEVE | 4.3 | 123 | A | C |
| Comparative Example A-3 | 34 | 26 | 1.3 | a | PEVE | 4.3 | 70 | C | A |
| Comparative Example A-4 | 33 | 33 | 1.0 | a | PEVE | 4.3 | 71 | C | A |
| Comparative Example B-1 | 11 | 10 | 1.1 | b | PPVE | 1.2 | 233 | A | C |
| Comparative Example B-2 | 17 | 14 | 1.2 | b | PPVE | 1.2 | 207 | B | C |
| Comparative Example B-3 | 22 | 17 | 1.3 | b | PPVE | 1.2 | 185 | C | C |
| Comparative Example B-4 | 26 | 20 | 1.3 | b | PPVE | 1.2 | 160 | C | C |
| Comparative Example B-5 | 28 | 21 | 1.3 | b | PPVE | 1.2 | 144 | C | C |
| Comparative Example B-6 | 31 | 24 | 1.3 | b | PPVE | 1.2 | 127 | C | C |
| Comparative Example B-7 | 34 | 26 | 1.3 | b | PPVE | 1.2 | 115 | C | C |
| Example C-1 | 26 | 20 | 1.3 | c | PEVE | 3.0 | 85 | A | A |
| Example C-2 | 28 | 21 | 1.3 | c | PEVE | 3.0 | 81 | A | A |
| Example D-1 | 26 | 20 | 1.3 | d | PEVE | 5.8 | 80 | A | A |
| Example D-2 | 28 | 21 | 1.3 | d | PEVE | 5.8 | 76 | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-233134, filed Nov. 17, 2014, which is hereby incorporated by reference herein in its entirety.

REFERENCE SIGNS LIST

11 Fixing belt
12 Fixing roller
13 Substrate
14 Elastic layer
15 Release layer

The invention claimed is:

1. A fixing member, comprising:

a substrate;

an elastic layer; and a release layer on the elastic layer, in this order, wherein the release layer contains a tetrafluoroethylene-perfluoroalkyl vinyl ether copolymer, wherein a content of the perfluoroalkyl vinyl ether based on all tetrafluoroethylene-perfluoroalkyl vinyl ether copolymers in the release layer is 3.0 mol % to 5.8 mol %, and wherein the elastic layer has an indentation elastic modulus $E_{ITs}$ at a surface thereof and an indentation elastic modulus $E_{ITc}$ at a position at a depth of 50 μm from the surface, $E_{ITs}$ and $E_{ITc}$ being measured at a temperature of 150° C., such that $E_{ITs}$ is larger than $E_{ITc}$, and $E_{ITc}$ is 17 MPa to 24 MPa.

2. The fixing member according to claim 1, wherein $E_{ITc}$ and $E_{ITs}$ satisfy a relation: $E_{ITs} \geq 1.3 \times E_{ITc}$.

3. The fixing member according to claim 1, wherein $E_{ITc}$ is 20 MPa to 21 MPa.

4. The fixing member according to claim 1, wherein the perfluoroalkyl vinyl ether is perfluoro(ethylvinyl ether).

5. The fixing member according to claim 1, wherein the elastic layer comprises an addition-curable silicone rubber.

6. The fixing member according to claim 1, wherein the elastic layer has a surface irradiated with UV rays.

7. The fixing member according to claim 1, wherein the elastic layer has a thickness of 100 μm to 500 μm.

8. A fixing device for fixing an unfixed toner on a recording medium onto the recording medium by heating under pressure, comprising a fixing member, wherein the fixing member comprises:

a substrate;

an elastic layer; and a release layer on the elastic layer, in this order, wherein the release layer contains a tetrafluoroethylene-perfluoroalkyl vinyl ether copolymer, wherein a content of the perfluoroalkyl vinyl ether based on all tetrafluoroethylene-perfluoroalkyl vinyl ether copolymers in the release layer is 3.0 mol % to 5.8 mol %, and wherein the elastic layer has an indentation elastic modulus $E_{ITs}$ at a surface thereof and an indentation elastic modulus $E_{ITc}$ at a position at a depth of 50 μm from the surface, $E_{ITs}$ and $E_{ITc}$ being measured at a temperature of 150° C., such that $E_{ITs}$ is larger than $E_{ITc}$, and $E_{ITc}$ is 17 MPa to 24 MPa.

9. An image forming apparatus for forming a toner image on a recording medium, comprising a fixing device for fixing an unfixed toner on a recording medium onto the recording medium by heating under pressure, wherein the fixing device comprises a fixing member, and wherein the mixing member comprises:

a substrate;

an elastic layer; and a release layer on the elastic layer, in this order, wherein the release layer contains a tetrafluoroethylene-perfluoroalkyl vinyl ether copolymer, wherein a content of the perfluoroalkyl vinyl ether based on all tetrafluoroethylene-perfluoroalkyl vinyl ether copolymers in the release layer is 3.0 mol % to 5.8 mol %, and wherein the elastic layer has an indentation elastic modulus $E_{ITs}$ at a surface thereof and an indentation elastic modulus $E_{ITc}$ at a position at a depth of 50 μm from the surface, $E_{ITs}$ and $E_{ITc}$ being measured at a temperature of 150° C., such that $E_{ITs}$ is larger than $E_{ITc}$, and $E_{ITc}$ is 17 MPa to 24 MPa.

* * * * *